US010994441B2

(12) United States Patent
Tarrant

(10) Patent No.: US 10,994,441 B2
(45) Date of Patent: May 4, 2021

(54) SYSTEM AND METHOD OF CONCEALING PERMANENT HARD POINT ATTACHMENTS BELOW A PAVER STONE SURFACE

(71) Applicant: Patrick M. Tarrant, New York, NY (US)

(72) Inventor: Patrick M. Tarrant, New York, NY (US)

( * ) Notice: Subject to any disclaimer, the term of this patent is extended or adjusted under 35 U.S.C. 154(b) by 0 days.

(21) Appl. No.: 16/662,437

(22) Filed: Oct. 24, 2019

(65) Prior Publication Data

US 2020/0130228 A1 Apr. 30, 2020

Related U.S. Application Data

(60) Provisional application No. 62/749,969, filed on Oct. 24, 2018.

(51) Int. Cl.

| | |
|---|---|
| ***E04B 1/41*** | (2006.01) |
| ***E04G 21/14*** | (2006.01) |
| ***B28B 23/00*** | (2006.01) |
| ***B66C 23/26*** | (2006.01) |
| *E02D 27/32* | (2006.01) |
| *B66C 23/64* | (2006.01) |

(52) U.S. Cl.

CPC ..... *B28B 23/005* (2013.01); *B66C 23/26* (2013.01); *E04B 1/41* (2013.01); *E04G 21/142* (2013.01); *B66C 23/64* (2013.01); *E02D 27/32* (2013.01)

(58) Field of Classification Search

CPC ..... B28B 23/005; B66C 23/26; B66C 23/64; E04G 21/142

USPC ..... 52/116

See application file for complete search history.

(56) References Cited

U.S. PATENT DOCUMENTS

| | | | | |
|---|---|---|---|---|
| 3,052,449 | A | 9/1962 | Long | |
| 4,017,115 | A | 4/1977 | Holt | |
| 4,096,952 | A * | 6/1978 | Diggs | B66C 23/201 212/176 |
| 4,348,841 | A | 9/1982 | Ueno | |
| 4,507,069 | A | 3/1985 | Murray | |
| 5,211,526 | A * | 5/1993 | Robinette | B60P 1/5471 212/238 |
| 5,281,078 | A * | 1/1994 | Mills, Jr. | B66C 23/44 212/180 |
| 5,363,614 | A * | 11/1994 | Faulkner | B26D 3/008 52/262 |
| 5,445,487 | A * | 8/1995 | Koscinski, Jr. | B60P 1/5433 212/232 |
| 5,732,522 | A | 3/1998 | Obermeier | |

(Continued)

*Primary Examiner* — Paola Agudelo
(74) *Attorney, Agent, or Firm* — Richard Malagiere

(57) ABSTRACT

A method for installing and deploying concealed mounting points for a davit or jib crane on a roof patio or large balcony covered with stone pavers. Specifically, a metal plate assembly lower flange is affixed to the concrete roof slab with its contact points covered by waterproofing membrane. The metal assembly hard point upper flange holes correspond to the holes in the mounting base of the davit or jib crane. The metal assembly when installed is lower than the pavers supported by metal pedestal transition components. As such, the metal assembly hard point is concealed and covered by a removable cover plate that also sits on top of the metal pedestal transition components and is flush with the top of the pavers.

14 Claims, 6 Drawing Sheets

(56) References Cited

U.S. PATENT DOCUMENTS

| | | | | |
|---|---|---|---|---|
| 5,782,446 | A * | 7/1998 | Ghahremani | E04G 3/34 248/220.21 |
| 6,082,561 | A * | 7/2000 | Bembas | B60P 1/5452 212/180 |
| 6,135,300 | A * | 10/2000 | Fox | B66C 23/208 182/60 |
| 6,322,038 | B1 * | 11/2001 | Ghahremani | E04G 3/34 248/500 |
| 6,345,472 | B1 | 2/2002 | Taylor | |
| 6,401,863 | B1 * | 6/2002 | Kirkland | B66D 3/20 182/142 |
| 7,178,181 | B1 * | 2/2007 | Fulmer | A61G 7/1015 212/179 |
| 8,015,750 | B2 * | 9/2011 | Yoshida | A01G 9/033 47/65.9 |
| 9,702,139 | B2 | 7/2017 | Espinosa | |
| 9,982,439 | B2 * | 5/2018 | Essig | E04D 11/005 |
| 10,047,516 | B2 | 8/2018 | Espinosa | |
| 2014/0096459 | A1 * | 4/2014 | Recker | E04G 21/142 52/125.5 |
| 2016/0244979 | A1 * | 8/2016 | Greaves | E04F 15/02476 |
| 2017/0138036 | A1 * | 5/2017 | Priester | E03F 5/0409 |

* cited by examiner

A - A

SYSTEM AND METHOD OF CONCEALING PERMANENT HARD POINT ATTACHMENTS BELOW A PAVER STONE SURFACE

PRIORITY

This application claims priority to Provisional Application 62/749,969 filed on Oct. 24, 2018.

BACKGROUND OF INVENTION

The present invention addresses a method of providing permanent concealed mounting points for a davit or jib crane on top of a roof patio area or large balcony of a high-rise building; specifically, located at the edges of the roof. It is often the case that large heavy equipment, artwork, furniture or the like needs to be lifted from street level up to a roof patio or large balcony. In these cases a crane is needed to lift these items. These items are too awkward and large to load in a building service elevator (e.g., large pieces of art work, sculptures, paintings, pianos, large pieces of custom furniture or cabinetry) and since the high-rise structure is already built and construction is long over, there is no large crane present that can be used for this function.

Currently, the process of bring these items up to the desired location on the roof patio or large balcony involves disassembling, transporting and reassembling modular cranes on the roof patio or balcony where the load is to be brought. These modular cranes are large, difficult to disassemble and reassemble and time consuming and cumbersome to transport in a building cargo elevator. The present invention provides a method where permanent hard points for the base plate of a davit or jib crane are available on the roof patio or large balcony. These hard points are concealed below paver stone surfaces on the roof patio or large balcony when not in use. The jib crane or davit is small (compared with a standard modular crane) and can be stored on the roof or a utility room of the building and taken out and installed on the permanent concealed hard points when needed.

The hard points are attached directly to the concrete roof slab and hidden below the stone pavers that often make up the surface of high-rise building roof patios or large balconies. Specifically, cover plates made of cementitious material or metal are placed over the hard points when not in use and conceal their existence. In this way, there is no unsightly break in the paver stone finish when the hard points are not being used.

BRIEF SUMMARY OF INVENTION

The present invention discloses a preferred embodiment of a method for installing and deploying a concealed metal plate assembly acting as a hard point for mounting a davit or jib crane to the roof slab of a roof patio or large balcony covered with stone pavers on a high-rise building. The metal plate assembly lower flange is affixed to the concrete roof slab and its points of contact are covered by a water proofing membrane. The metal plate assembly upper flange has holes configured to line up with the holes in the davit or jib crane mounting plate. The metal plate assembly when affixed is concealed below the metal pedestals on which the pavers are sitting such that a cover plate can sit over the metal plate assembly on the metal pedestals flush with the paver stones.

DRAWINGS

DETAILED DESCRIPTION OF INVENTION

Figure 1:
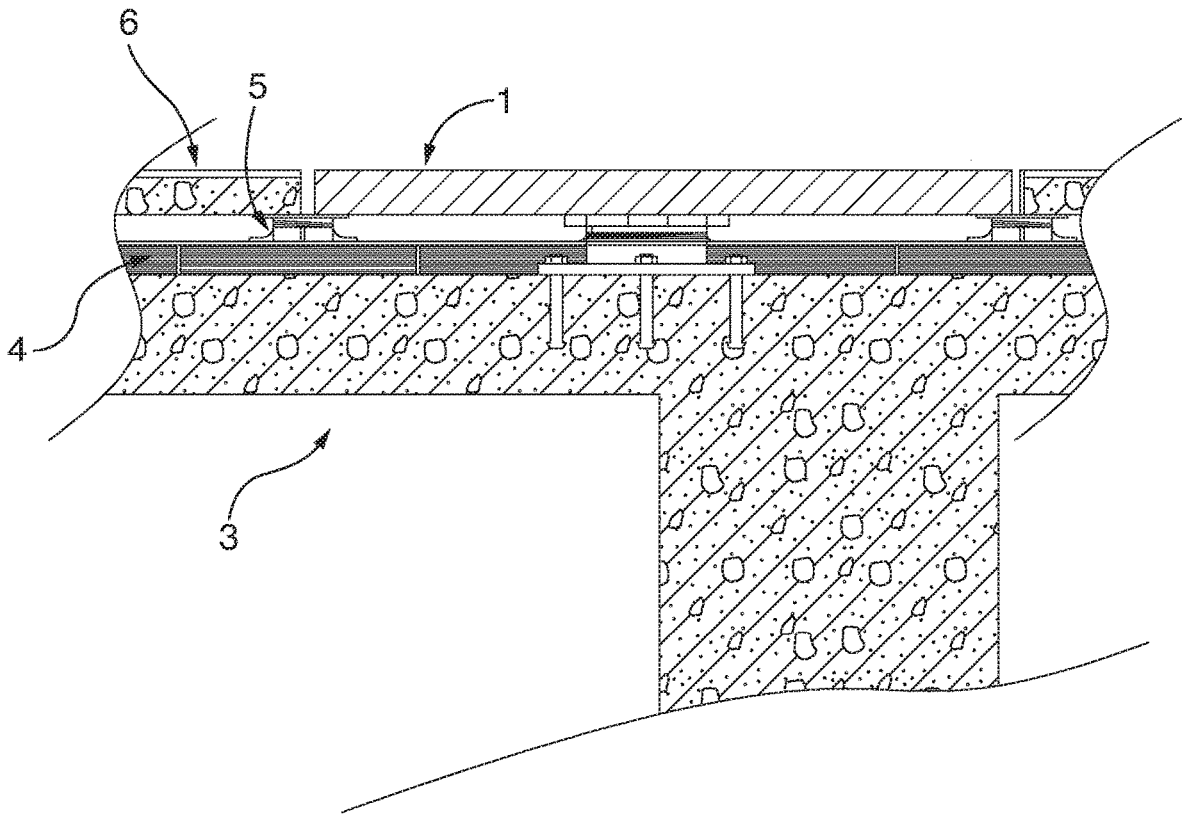
FIG. 1 is a cross section of an installed and hidden metal plate assembly.

The present invention will now be described in terms of the presently preferred embodiment thereof as illustrated in the drawings. Those of ordinary skill in the art will recognize that many obvious modifications may be made thereto without departing from the spirit or scope of the present invention.

The invention is associated with the operation of davit or jib crane on a roof patio or large balcony of a high-rise building. Specifically, with a method if installed concealed hard points for the attachment of a davit or jib crane base plate. These hard points are hidden when not in use and covered by a base plate that is flush with the stone pavers making up the base of the roof patio or large balcony.

Figure 2:
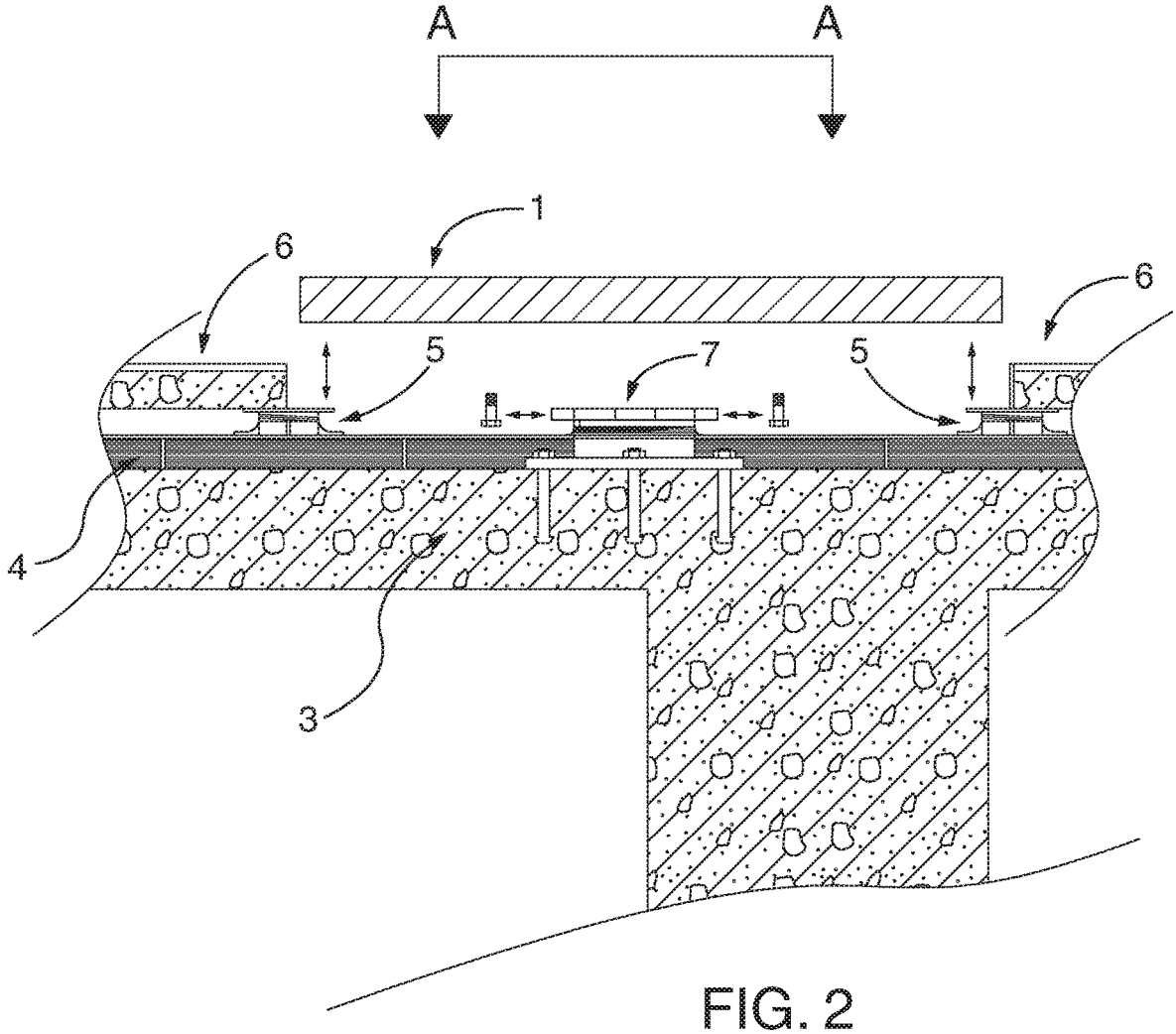
FIG. 2 is a side view of an installed and hidden metal plate assembly showing the cover plate removed.
Figure 2A:
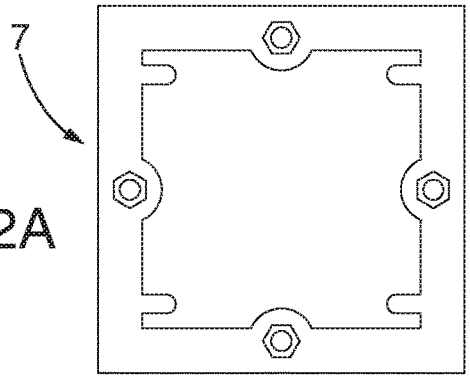
FIG. 2A is a top view of the metal plate assembly of FIG. 2.
Figure 6:
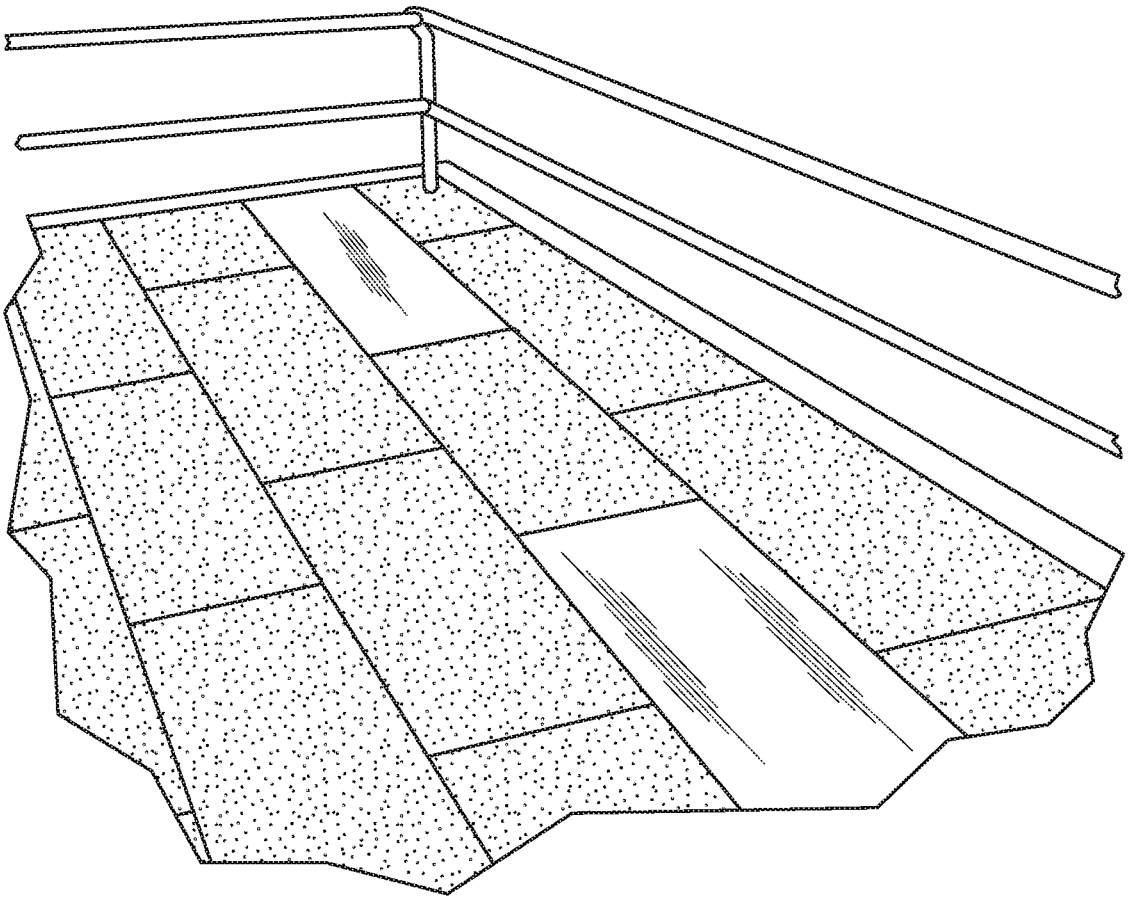
FIG. 6 is a view of a roof patio or large balcony of a high-rise building with the metal plate assemblies hidden and the cover plates in place.

In a preferred embodiment of the present invention, a metal plate assembly with a lower flange and upper flange (7) is attached at the lower flange to a concrete slab (3) of a high-rise building. FIG. 1 and FIG. 2. The metal plate assembly (7) is made out of steel or stainless steel but could be made from aluminum. The lower flange of the metal plate assembly (7) as affixed to the concrete slab (3) by means of lag bolts inserted into threaded anchors or shields set into the concrete slab (3). FIG. 1. Alternatively, threaded studs can be set into the concrete slab (3) corresponding to holes in the base plate of the metal plate assembly (7) and secured with nuts threaded onto the threaded studs. FIG. 2 and FIG. 2A. Either way, a waterproofing membrane (4) is set on top of the concrete slab (3) and on top of the lower flange of the affixed metal plate assembly (7). FIG. 1. Metal pedestal transition components (5) are set on top of the waterproofing membrane (4) and form the base or shelf on which stone pavers (6) are set and make up the floor of the roof patio or large balcony of the high-rise building. FIG. 1 and FIG. 6. Directly over the metal plate assembly (7) exposing the upper flange a cover plate (1) is set in place that is removable. FIG. 2. The cover plate (1) is made of metal or a cementitious material. Either way, the cover plate (1) is flush with the set-in-place stone pavers. FIG. 1, FIG. 2 and FIG. 6.

Figure 3:
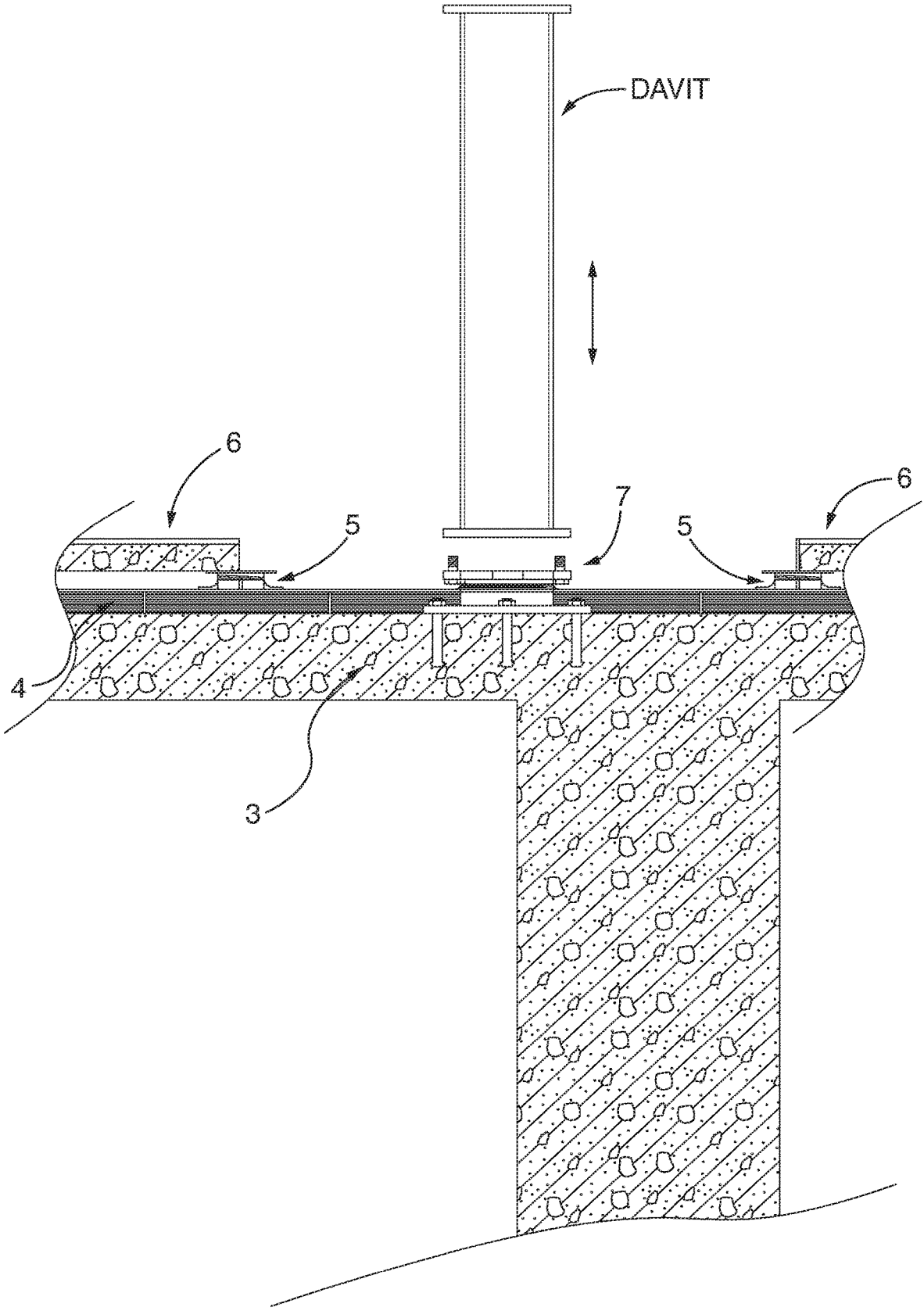
FIG. 3 is a side view of an installed and hidden metal plate assembly showing the cover plate removed and a davit or jib crane base plate being installed.
Figure 4:
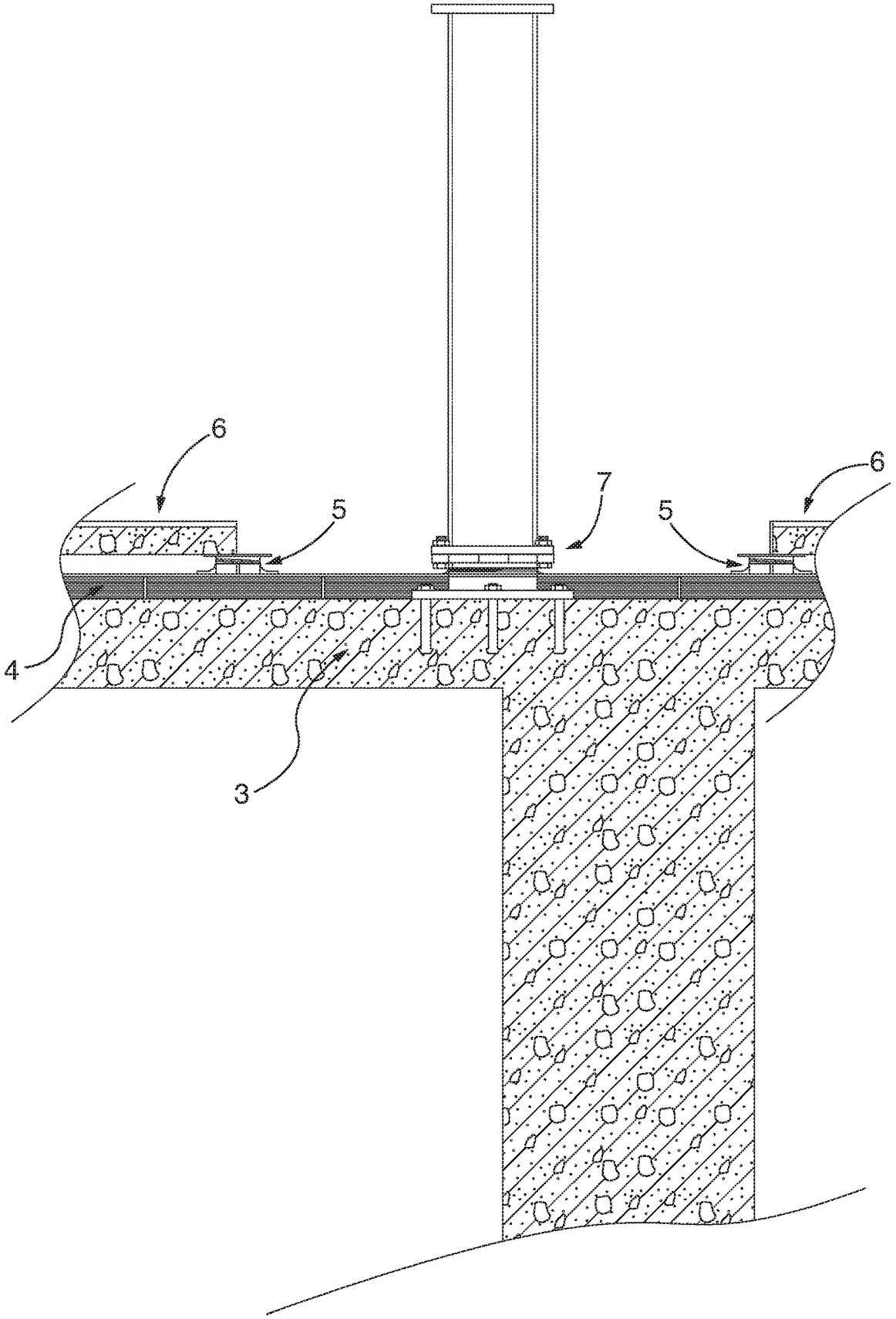
FIG. 4 is a side view of an installed and hidden metal plate assembly showing the cover plate removed and a davit or jib crane base plate in place.
Figure 5:
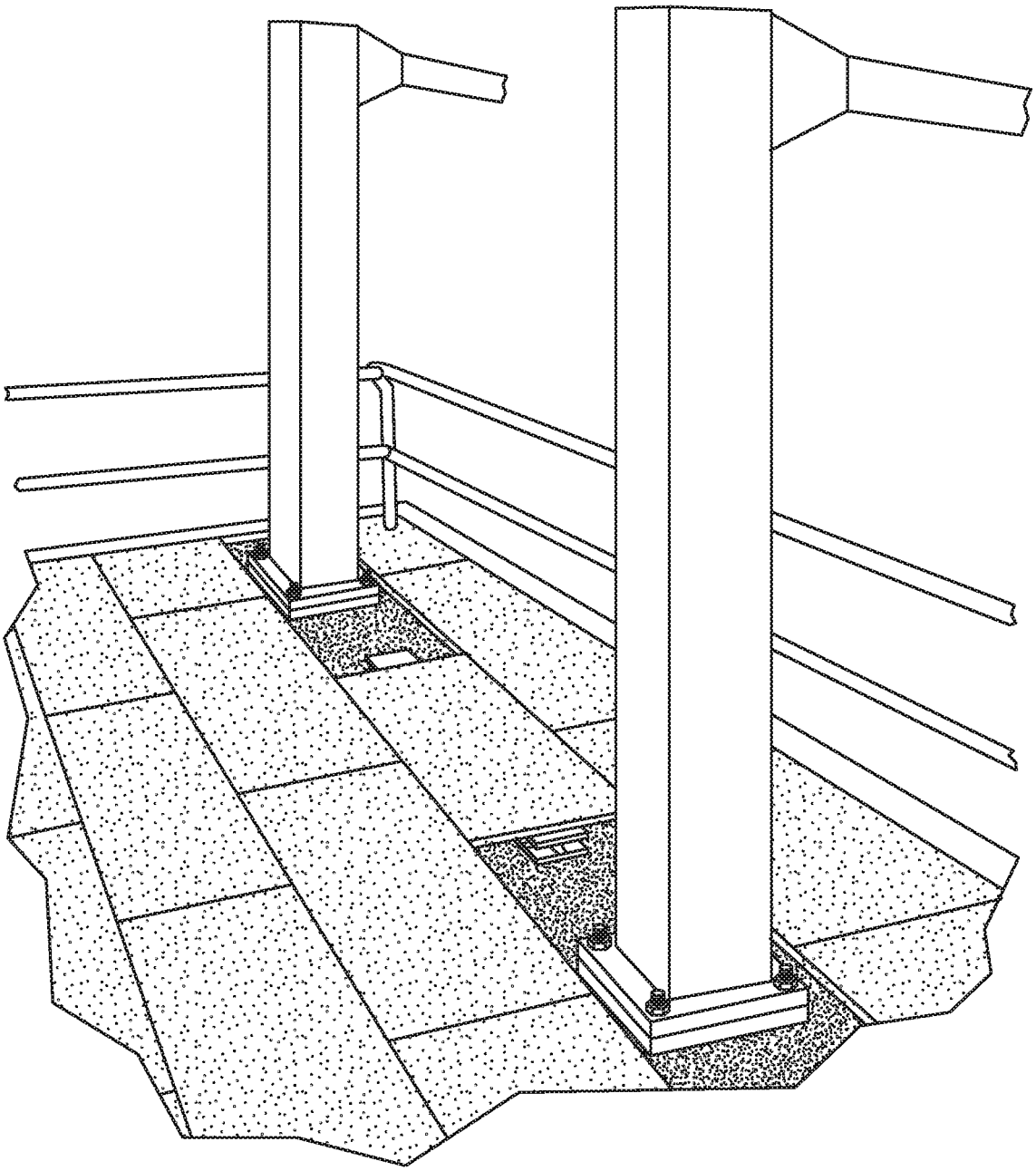
FIG. 5 is a view of a roof patio or large balcony of a high-rise building with two davits or job cranes installed onto the current invention.

When a load situated on street level needs to be moved to a roof patio or large balcony of a high-rise building where the metal plate assembly "hard points" have been installed into the concrete slab (3) and near the edge of the roof patio or large balcony, the following method is employed. The base plate (1) is removed exposing the upper flange of the metal plate assembly (7). FIG. 2 and FIG. 2A. A davit or jib crane stored on the roof patio or large balcony or near by is brought to the exposed metal plate assembly (7) and installed onto it. Specifically, the mounting holes in the base plate of the davit or jib crane are aligned onto the slots in the upper flange of the metal plate assembly (7)—see, FIG. 2A—and bolts are inserted into the slots in the metal plate assembly (7) through the mounting holes in the davit or jib crane base plate and secured by nuts and lock washers. FIG. 2, FIG. 3 and FIG. 7. The davit or jib crane is now hard mounted to the concrete slab (3) by means of the metal plate assembly (7) and situated at the edge of the roof patio or large balcony of a high-rise building. FIG. 5. In this configuration, the davit or jib crane is in position to lift a load situated on street level or a load from a balcony or roof patio below. Of course, depending on the number of metal plate assemblies (7) installed in the concrete slab (3) of the particular roof patio or large balcony, any number of davits or jib cranes may be employed. See, FIG. 5. Further, depending on the spacing of the metal plate assemblies (7) installed in the concrete slab (3) of the particular roof patio or large balcony, a davit or jib crane with more than one mounting plate may be employed.

Once the davit or jib crane is no longer needed, the base plate of the davit or jib crane is unbolted from the upper flange of the metal plate assembly (7) and removed for storage. The bolts, nuts and lock washers used to secure the metal plate assembly upper flange (7) to the base plate of the davit or jib crane (see, FIG. 2A) are removed and stored and the removable cover plate is re-set in place. FIG. 6.

Many uses and configurations of the present invention may be employed. For instance, the davit or jib crane may be mounted in reverse so that its boom does not extend over the side the high-rise building and instead can be used to lift objects on the roof deck or large patio itself. Further, while the instant invention in its preferred embodiment is directed to the use of a davit or jib crane type lifting devices, nothing in the claims set out or in this disclosure would preclude and arrangement of metal plate assemblies (7) configured in such a way to provide for the mounting of any number of crane types.

Those of ordinary skill in the art will recognize that the embodiments just described merely illustrate the principles of the present invention. Many obvious modifications may be made thereto without departing from the spirit or scope of the invention as set forth in the appended claims.

The invention claimed is:

1. A method for concealing permanent hard point connections on a stone or concrete paver surface set on top of a concrete slab, a waterproofing membrane and metal pedestal transition components on which the pavers are set where a metal plate assembly with a lower flange and upper flange has the lower flange affixed to the concrete slab and the upper flange has slots which communicate with the holes in the mounting base of a davit or jib crane and a removable cover plate is set over the metal plate assembly comprising the following steps:

pouring the concrete slab;

laying the waterproofing membrane on top of the concrete slab;

removing the membrane directly over the area where the metal plate assembly is to be affixed to the concrete slab;

setting the metal pedestal transition components on the concrete slab;

affixing the lower flange of the metal plate assembly to the concrete slab in select locations on the concrete slab such that the upper flange of the metal plate assembly is positioned above and apart from the concrete slab and wherein the upper flange is positioned lower than a top surface of the metal pedestal transition components;

covering the lower flange of the affixed metal plate assembly with the waterproofing membrane;

setting the pavers on top of the metal pedestal transition components;

setting the removable cover plate over the metal plate assembly on top of the metal pedestal transition components.

2. The method of claim 1, where the metal plate assembly is made of stainless steel.

3. The method of claim 1, where the metal plate assembly is made of aluminum.

4. The method of claim 1, where the metal plate assembly is made of steel.

5. The method of claim 1, where the removable cover plate is made of stainless steel.

6. The method of claim 1, where the removable cover plate is made of steel.

7. The method of claim 1, where the removable cover plate is made of aluminum.

8. The method of claim 1, where the removable cover plate is made of cementitious material.

9. The method of claim 1, where the select locations for the placement of the metal plate assemblies on the concrete slab are at edges of the area covered by the paver stones.

10. A method for mounting a davit or jib crane on concealed permanent hard point connections on a stone or concrete paver surface set on top of a concrete slab, a waterproofing membrane and metal pedestal transition components on which the pavers are set where a metal plate assembly with a lower flange and upper flange has the lower flange affixed to the concrete slab and an upper flange has slots which communicate with the holes in the mounting plate of a davit or jib crane and a removable cover plate is set over the metal plate assembly comprising the following steps:

removing the removable cover plate in order to expose the upper flange of the metal plate assembly;

inserting bolts into the slots in the upper flange of the exposed metal plate assembly corresponding to the holes in the base plate of the davit or jib crane to be mounted;

bolting the davit or jib crane base plate to the upper flange of the exposed metal plate assembly such that a bottom end of the davit or jib crane is lower than a top surface of the metal pedestal transition components, and wherein the upper flange is positioned above and apart from the concrete slab and wherein the upper flange is positioned lower than a top surface of the metal pedestal transition components; operating the davit or jib crane;

unbolting the davit or jib crane base plate from the upper flange of the exposed metal plate assembly;

removing the bolts from the upper flange of the exposed metal plate assembly;

removing the davit or jib crane; and replacing the removable cover plate over the exposed metal plate assembly.

11. The method of claim 10, where two davits or jib cranes attach to a plurality of corresponding exposed metal plate assemblies.

12. The method of claim 10, where the permanent hard point connections on a stone or concrete paver surface set on top of a concrete slab is set on the edge of a flat roof of a high-rise building.

13. The method of claim 10, where the permanent hard point connections on a stone or concrete paver surface set on top of a concrete slab is set on the edge of a roof patio area of a high-rise building.

14. The method of claim 10, where the permanent hard point connections on a stone or concrete paver surface set on top of a concrete slab is set on the edge of a large balcony area of a high-rise building.

* * * * *